US006988941B2

(12) United States Patent
Saunier et al.

(10) Patent No.: US 6,988,941 B2
(45) Date of Patent: Jan. 24, 2006

(54) ENGAGING ASSEMBLY FOR ABRASIVE BACK-UP PAD

(75) Inventors: Robert G. Saunier, North St. Paul, MN (US); James W. Malaske, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 264 days.

(21) Appl. No.: 10/610,774

(22) Filed: Jul. 1, 2003

(65) Prior Publication Data

US 2005/0079802 A1 Apr. 14, 2005

(51) Int. Cl.
*B24B 41/00* (2006.01)

(52) U.S. Cl. ..... 451/490; 451/538

(58) Field of Classification Search ..... 451/490, 451/495, 521, 523, 526, 533, 538
See application file for complete search history.

(56) References Cited

U.S. PATENT DOCUMENTS 3,346,904 A 10/1967 Armstrong
4,184,291 A 1/1980 Marton
4,287,685 A 9/1981 Marton
5,505,747 A 4/1996 Chesley et al.
5,692,949 A 12/1997 Sheffield et al.
5,725,423 A 3/1998 Barry et al.
5,962,102 A * 10/1999 Sheffield et al. ..... 428/92
5,962,120 A 10/1999 Keipert
6,099,603 A 8/2000 Johnson
6,371,837 B1 * 4/2002 Luedeke ..... 451/57
6,579,161 B1 * 6/2003 Chesley et al. ..... 451/538

* cited by examiner

*Primary Examiner*—Jacob K. Ackun, Jr.
(74) *Attorney, Agent, or Firm*—Rick L. Franzen

(57) ABSTRACT

A back-up pad for supporting an abrasive article is disclosed. The back-up pad includes an engagement assembly bonded to a first major surface. The engagement assembly includes a first region including a plurality of first engagement means having a first durability. The engagement assembly also includes a second region including a plurality of second attachment means having a second durability. The first engagement means have a substantially higher durability than the second engagement means.

47 Claims, 3 Drawing Sheets

ENGAGING ASSEMBLY FOR ABRASIVE BACK-UP PAD

FIELD

The present disclosure relates generally to back-up pads for use with abrasive articles, and more particularly to back-up pads for mechanically attaching abrasive articles to the back-up pad.

BACKGROUND

Back-up pads are used in the abrasives field to support an abrasive disc or sheet during abrading. The term "abrading" as used herein includes all methods of material removal due to frictional contact between contacting surfaces in relative motion, such as grinding, sanding, polishing, burnishing, or refining. The abrasive articles can be any suitable abrasive article such as coated abrasives, lapping coated abrasives, non-woven abrasives or buffing pads. These abrasive articles can be in various forms, such as a disc, a sheet, or a polygon and, may optionally, contain holes or slits to aid in dust extraction. The back-up pad includes a generally planar major surface, to which the abrasive article, such as a disc or sheet, may be attached. Although back-up pads may be hand held, back-up pads are more commonly used in conjunction with a powered abrading apparatus such as electric or pneumatic sanders.

Abrasive discs and sheets (hereinafter "discs") may be attached to a back-up pad in various ways. One attachment method includes an abrasive disc having pressure sensitive adhesive (PSA) on one surface thereof, such that the abrasive disc may be adhered to the major surface of the back-up pad. The major surface of the back-up pad may have, for example, a smooth foam, vinyl, or cloth surface to facilitate attachment of the abrasive disc. An example of such a back-up pad is available from 3M Company of St. Paul, Minn., under the designation "STIKIT" brand back-up pad. An example of an abrasive disc for attachment to that back-up pad is available from the same company under the designation "STIKIT" brand abrasive disc.

A second type of back-up pad includes a major surface having a plurality of hooks projecting therefrom. The hooks are adapted to engage certain structures provided on the back face of an abrasive disc to releasably attach the disc to the back-up pad. An example of such a back-up pad is available from the 3M Company of St. Paul, Minn., under the designation "HOOKIT" brand back-up pad, and an example of an abrasive disc for attachment to that back-up pad is available from the same company under the designation "HOOKIT" brand abrasive disc. Alternatively, the back-up pad major surface can include engaging structures to cooperate with hooks on an abrasive disc. An example of such an assembly is available from 3M Company under the designation "HOOKIT II" brand back-up pad and abrasive disc.

The back-up pads described above are often used with dual action sanders ("DA sanders"), which are well known in the art. Such sanders with back-up pads may be used for light duty sanding operations such as light sanding of painted surfaces between paint coats and sanding with very fine sandpaper to remove small paint imperfections such as dust nibs from the final paint coat. This type of sanding imparts light stress to the attachment interface. Such back-up pads may also be used for medium duty sanding operations such as final preparation of a workpiece surface for primer painting and sanding a workpiece surface having a primer paint thereon in preparation for subsequent painting. Light to medium downward pressures are typically applied during these types of sanding applications and impart a moderate amount of stress on the attachment interface. However, such sanders and back-up pads are often used under heavy duty sanding operations such as paint stripping or removing excess body filler where the operator would apply fairly heavy downward pressure. The back-up pad is often inclined at a relatively steep angle with respect to the workpiece surface and may also be pushed into crevices and over fairly sharp contours. The paint or body filler on the workpiece surface provides substantial resistance to the abrasive surface of the abrasive article attached to the back-up pad so that a considerable sanding force is often required to remove the paint or body filler. Such aggressive, heavy sanding operations apply substantial stress on the hook and loop attachment interface.

SUMMARY

One aspect of the present disclosure provides an engaging assembly, wherein the engaging assembly comprises a substrate having a front side and a back side, and a first region including a plurality of first engaging means and a second region including a second engaging means. The first and second engaging means comprise a plurality of loops projecting through the substrate from the back side to the front side, wherein the loops of the first engaging means have different durability than the loops of the second engaging means. The difference in durability may be achieved, for example, by utilizing different loop denier or loop material. The loop material may be selected as desired, and can include such organic materials as thermoplastic and thermosetting materials like polyamides (such as nylon), polyolefins, polyurethanes, aramids, polyester, cellulosic materials, or such inorganic materials as metal (including aluminum or steel) or ceramic (including glass and fiberglass). Each strand loop can also be comprised of a combination of different materials. The strand may be straight, curved, or twisted, and may contain a surface treatment of some type, such as an antistatic coating, or silicone. The surface coating may be selected to aid in the stitching process. The loops may be selected from the group consisting of stitched loops, warp knit, for example, tricot loops, formed loops, brushed loops or non-woven loops, or combinations thereof. The loops may further comprise a monofilament strand.

In another aspect of the present disclosure, the first and second regions are substantially concentric circles, wherein the first region surrounds the second region. The first region has a high durability and the second region has a high attachment strength. In another aspect of the present disclosure, the first region further includes a plurality of arcuate regions depending from the first to the second region. It is possible to have a gap between the first and second region, typically up to 1/16 inch (1.6 mm). The arcuate regions may be discrete or interconnected along the perimeter of the first region.

In another aspect of the present disclosure a back-up pad for attaching to an abrasive article having projecting hooking stems is provided. The back-up pad includes a support member including a major surface, and an engaging assembly is provided on the major surface for releasably engaging the hooking stems of the abrasive article. The back-up pad may further comprise ventilating apertures.

A further aspect of the present disclosure provides a method of making a back-up pad for supporting an abrasive article. The method comprises:

a) providing a substrate;

b) providing a plurality of first loops having a first diameter on a first region of the substrate;

c) providing a plurality of second loops having a second diameter on a second region of the substrate, wherein the second region is within the area bounded by and substantially adjacent with the first region, to form an engaging assembly;

d) bonding the engaging assembly to a major surface of a back-up pad; and e) converting the engaging assembly to be flush with the perimeter of the back-up pad, wherein b) and c) may be in any order, or provided simultaneously.

In yet another aspect, the present disclosure provides a method of refining the surface of an object, comprising:

a) providing a back-up pad comprising a first major surface, an engaging assembly bonded to the first major surface, the engaging assembly having a first region including a plurality of first engaging means, and a second region including a second engaging means, wherein the first region surrounds the second region and the first and second engaging means comprising loops having different durabilities;

b) attaching an abrasive article to the back-up pad;

c) contacting the surface of an object with the abrasive article; and d) relatively moving the abrasive article to refine the surface of the object.

BRIEF DESCRIPTION OF THE DRAWINGS

The present disclosure will be further explained with reference to the appended Figures, wherein like structures are referred to by like numerals throughout the several views, and wherein.

DETAILED DESCRIPTION

Figure 1:
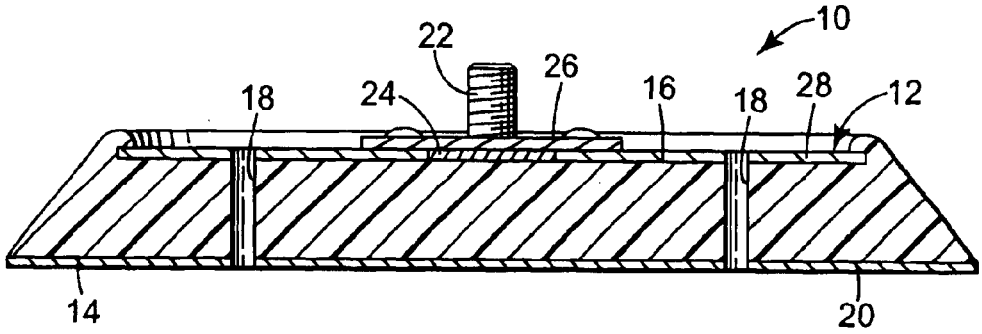
FIG. 1 is an elevation view of an example embodiment of a back-up pad according to the present disclosure.

It is believed a primary failure cause of loop assemblies on back-up pads is the rigorous vibrational action of the dual action (DA) sander combined with the large resistive sanding forces of removing paint or body filler during heavy sanding applications. Each vibrational action results in an impulse force being applied to the loops so that when there is large resistance to the motion of the abrasive surface, a correspondingly large impulsive force is transmitted to the loops. The DA sander vibrates hundreds of times per minute, thus imparting hundreds of large impulses per minute to the loops. This repetitive stress can cause fatigue failure of the loops. It is also believed that there is frictional wear between the loop material and any abraded substrate swarf. Applicants have found that this force accelerates the wear of loops in the outer region of back-up pads and also around ventilation holes that pass through back-up pads.

It is therefore desirable to provide a back-up pad having an engagement assembly that is durable enough to withstand a high number of attachments and removals of abrasive articles, and strong and durable enough to provide a sufficiently strong engagement with the abrasive article during high stress operations, while still allowing for easy removal of the abrasive article without substantial damage to the loop material.

Generally, the invention of the present disclosure is directed to a back-up pad including a major surface, also referred to as a front surface, which is adapted to releasably engage with hooking stems that project from any desired abrasive article, such as a disc or sheet. Typical abrasive articles having such hooking stems are disclosed in U.S. Pat. No. 5,505,747 (Chesley et al.), which is incorporated herein by reference. Examples of abrasive articles having such hooking stems include those commercially available from 3M Company of St. Paul, Minn., under the trade designation "HOOKIT II". The abrasive article is supported by the back-up pad for use in abrading the surface of a workpiece. The back-up pad can be configured for use as a hand pad or for use with any suitable power drive means. The back-up pad includes multiple regions of engaging means, for example, engaging members such as loops or their equivalent, including a region of higher durability in the region or regions of accelerated wear, which were described previously. As used herein, durability means the product of the tenacity of the material (in grams per denier) and the denier of the material of the structure. Typically, the durability is substantially different between two structures when the respective durability of each structure is at least 10 percent different, and more typically, more than 20 percent different, and most typically, greater than 45 percent different.

One example embodiment of a back-up pad includes a first, outer region having loops of made of nylon 66, each loop having a diameter of about 0.006 inches (0.152 mm). The pad also includes a second, inner region, inside the first region. The second region has loops made of nylon 66 having a diameter about of about 0.004 inches (0.102 mm). The increased diameter of the loops in the first region makes them more durable than the loops in the second region. The smaller diameter of the loops in the second region gives them more gripping or attachment force (on a typical hook) compared to the gripping force of the larger diameter loops. This arrangement provides for a back-up pad having a region of higher durability in regions of higher wear and also includes a region of higher attachment strength. Alternatively, the engaging members could be located on the abrasive disc and the hooks on the back-up pad using the above-described multiple regions.

Referring to FIG. 1, a back-up pad 10 of the present disclosure generally includes a support member 12 and an engaging assembly 20. Support member 12 includes a major surface 14, and typically a minor surface 16. Major surface 14 is shown as planar, but could have any suitable topography. The support member major surface may, for example, contain raised portions that increase the force applied to the work surface per area of the abrasive article, and can produce increased material removal rates. The shape of the back-up pad face typically is the same as the shape of the abrasive article to be carried by the back-up pad, although this is not required. Some popular back-up pad shapes include a square, a triangle, a rectangle, an oval, a circle, a pentagon, a hexagon, an octagon, or the like.

Figure 4:
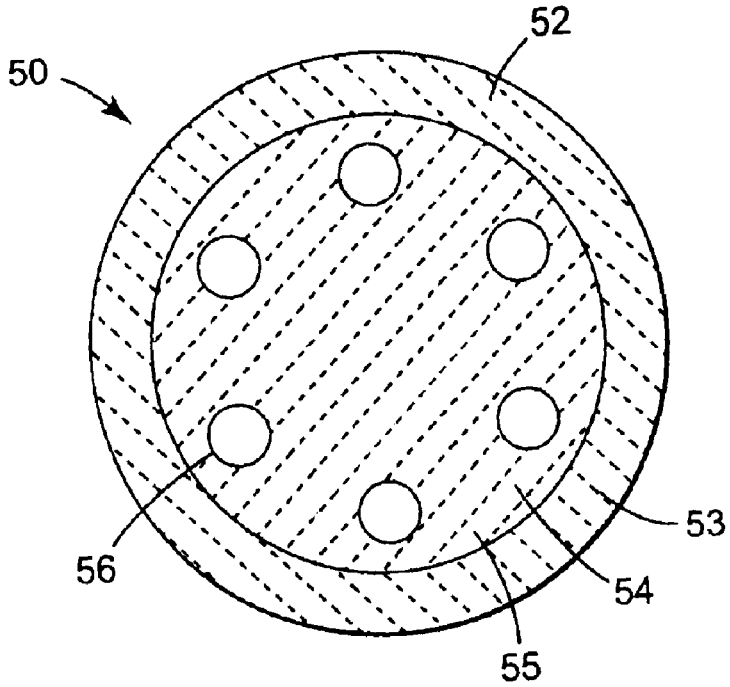
FIG. 4 is a plan view of an example embodiment of an engaging assembly according to the present disclosure.
Figure 5:
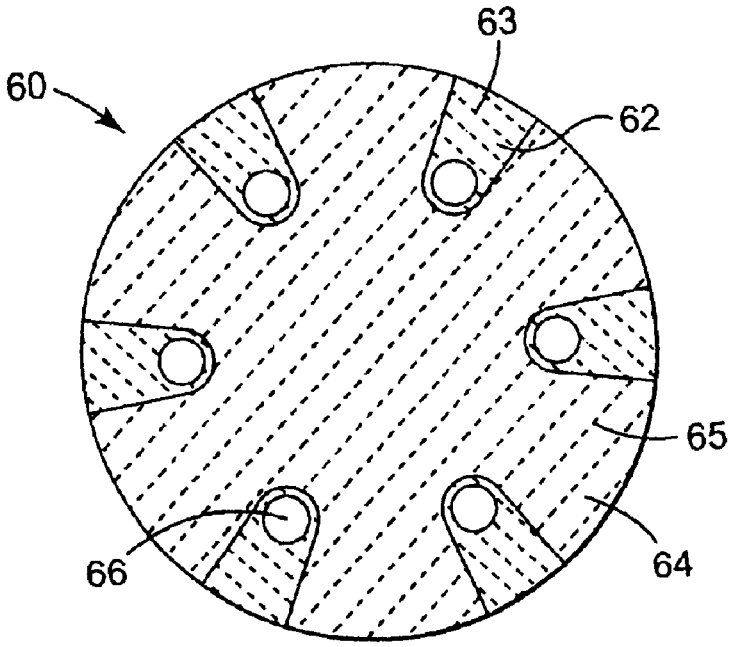
FIG. 5 is a plan view of another example embodiment of an engaging assembly according to the present disclosure.
Figure 6:
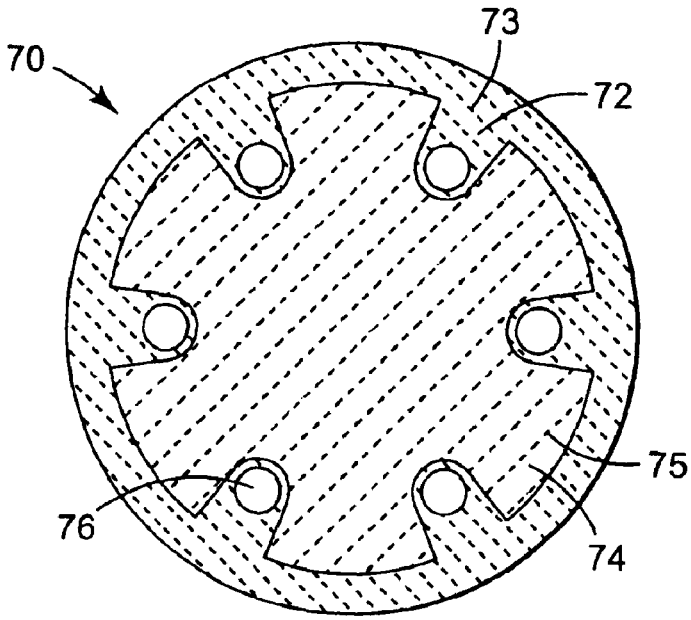
FIG. 6 is a plan view of another example embodiment of the engaging assembly according to the present disclosure.

The back-up pad of the present disclosure includes at least two regions of engaging members, with each region having a different durability. Examples of back-up pads having regions of different durability are illustrated in FIGS. 4–6, which will be discussed in detail hereinafter. It is preferred for engaging members to have a higher durability in the region (or regions) on the back-up pad that is subjected to higher stresses during operation. As previously discussed, accelerated wear of the engaging members appears in areas subjected to the higher operating stresses. Applicants have found that on circularly shaped back-up pads, areas of accelerated wear occur in the outer portion of the back-up pad (as discussed in the examples presented hereinafter) and also in areas having ventilating or dust-removal apertures. Upon reading this disclosure, one of ordinary skill in the art will appreciate that routine experimentation will show areas of accelerated wear on such back-up pads (or abrasive discs) and applying the principles taught herein, be able to identify areas or regions of accelerated wear and design a back-up pad having regions of higher durability engaging members in areas of accelerated wear.

The diameter for a circular back-up pad 10 generally ranges from about 1.25 to 125 cm (0.5 to 50 inches), and more typically from about 2.5 to 75 cm (1 to 30 inches). The length and/or width of a non-circular back-up pad is usually on the same order, and can range from about 1.25 to 125 cm (0.5 to 50 inches), typically about 2.5 to 75 cm (1 to 30 inches). The back-up pad may also have a slightly smaller diameter than the abrasive article. For example, the abrasive article may overhang the back-up pad by a very slight amount—typically less than 0.25 cm (0.1 inch), and more typically less than 0.13 cm (0.05 inch). The thickness of the support member is typically in the range of 0.6 to 12.5 cm (0.25 to 5.0 in), although larger and smaller thickness are possible. The thickness of the support member may also vary at different locations of the back-up pad.

The support member may be designed for use with a desired abrading application. For example, for wood and some metal sanding, the support member of the back-up pad is typically made of a compressible, resilient material, such as open or closed cell polymeric foams (such as soft closed cell neoprene foam, open cell polyester foam, polyurethane foam, reticulated or non-reticulated slabstock foams), rubber, porous thermoplastic polymers, or the like. Typical polyurethane-based foams include toluene diisocyanate (TDI) based foam and methylene di (or bis) phenyl diisocyanate (MDI) based foam. For some applications, it is desirable to construct the support portion from a more rigid material, to facilitate the transmission of abrading forces in a localized area, such as for heavy stock removal or relatively high pressure abrading. Examples of suitable rigid materials include steel (including stainless steel and mild steel), hard rubbers, vulcanized rubbers, thermosetting polymers such as crosslinked phenolic resins, ceramics, laminated or pressed fibers, and the like, as disclosed in U.S. Pat. No. 5,962,120 (Keipert), which is incorporated herein by reference.

The support member 12 may also include an optional facing (not shown), which protects the support member 12 and anchors the engaging assembly 20 to the back-up pad. The front facing may comprise such materials as cloth, non-woven substrates, treated cloth, treated non-woven substrates, polymeric films, or the like. Typical front facing materials include nylon-coated cloths, vinyl coated non-wovens, vinyl coated woven fabrics, or treated woven fabrics.

If the back-up pad 10 is intended to be mounted on a machine for movement thereby, the back-up pad 10 will typically have some type of mechanical attachment means on minor surface 16. For instance, for random orbital applications the support member may include a threaded shaft 22 adjoining the minor surface 16 and projecting orthogonally therefrom. The threaded shaft 22 may be engaged with the output shaft of the machine, and the back-up pad 10 secured to the machine thereby. Other attachment means are also possible, including, but not limited to, an unthreaded shaft, a threaded nut, a threaded washer, adhesives, or magnets. A backing plate 28 may also be provided, and may overlie the minor surface 16, as shown in FIG. 1, to provide added rigidity to the back-up pad 10. In such an embodiment, shaft 22 has head 24 retained to the back-up pad 10 by retainer 26 that is riveted to the support plate 28. Alternately, the backing plate 24 may be incorporated into the support member to provide additional rigidity.

If the back-up pad is intended to be used by hand, the support member may include a handle that makes the apparatus easier to manipulate. The handle is typically provided in place of the attachment means described in the preceding paragraph, but could instead be secured to the attachment means. Other suitable handle configurations can be provided as desired, and are within the knowledge or skill of those having ordinary skill in the art.

The back-up pad may also include one or more holes, apertures, or passageways through which dust, debris, or an abrading fluid (such as water or oil) may be removed from the abrading surface. Passageways 18, shown in FIG. 1, are typically connected to a vacuum source that removes any generated dust and debris from the abrading surface. A mating abrasive article typically includes holes in a size and pattern matching the passageways in the back-up pad of the present disclosure. U.S. Pat. No. 4,184,291 (Marton) and U.S. Pat. No. 4,287,685 (Marton), the contents of which are incorporated herein by reference, further describe such dust removal passageways and holes. Passageways may also or instead be provided for the provision or removal of water or other lubricants or grinding aids.

The back-up pad of the disclosure also includes an engaging assembly 20 adjoining major surface 14. Engaging assembly 20 facilitates the releasable attachment of an abrasive article as described further hereinafter. Engaging assembly 20 may directly adjoin or be integral with major surface 14, or may be bonded to optional front facing or to other intermediate layers that are bonded to major surface 14. Although engaging assembly 20 may take one of many different forms, each embodiment shares the common feature that the engaging surface is adapted for releasable engagement with a plurality of hooking stems or their equivalents. As used herein, a hooking stem means a stem having 1) a free end that is spaced from the surface to which the stem is attached, and 2) a structure that enables the hooking stem to releasably hook the features of the engaging surface. Two example structures that enable a hooking stem to releasably hook the engaging surface, as described in U.S. Pat. No. 5,505,747 (Chesley et al.), discussed above, are a head adjoining each stem, or a stem having an included distal end angle of less than approximately 90 degrees. It should be noted that it is not necessary that all of the hooking stems must engage with the engaging surface, but a sufficient number of hooking stems should be engaged to enable the abrasive article to be easily attached to and detached from the back-up pad, while preventing the abrasive article from shifting significantly relative to the back-up pad during use.

Figure 2:
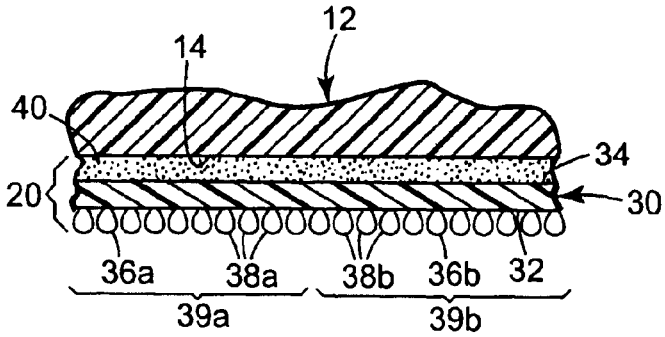
FIG. 2 is an enlarged partial cross-sectional view of an example embodiment of an engaging assembly portion of the back-up pad of FIG. 1.

One example embodiment of an engaging assembly 20 adapted for releasable engagement with a plurality of hooking stems is illustrated in FIG. 2. Engaging assembly 20 includes a substrate 30. Substrate 30 can be any suitable substrate to which strands 36*a* and 36*b* may be stitched to form a plurality of loops 38*a* and 38*b* extending from first surface 32 of substrate 30. First region 39*a* and second region 39*b* are defined by loops 38*a* and 38*b* respectively. Strands 36*a* and 36*b* differ in durability, and more typically strands 36*a* have a diameter greater than strands 36*b*. Substrate 30 should be chosen to allow a needle to penetrate the substrate when forming loops 38*a* and 38*b*, to provide adequate support for the loops and to provide an adequate bond with adhesive layer 40, as will be described in more detail hereinafter, and to avoid picking and snagging by the needle when forming loops 38*a* and 38*b*. Choosing a suitable substrate is within the skill and knowledge of one of ordinary skill in the art. Typical materials for substrate 30 include woven fabrics, such as polyester, fortrel polyester gabardine, 65/35 polyester/cotton blend poplin, rip stop nylon, cotton canvas, polyester double knit, 50/50 cotton/polyester blend, cotton twill or woven cellulosic fabric, such as cotton or rayon. Loops 38*a* and 38*b* are configured to releasably engage the hooking stems of the back side of the abrasive article to attach the abrasive article to the back-up pad 10.

In one example embodiment, the engaging assembly 20 is secured to the major surface 14 of the support member 12 by an adhesive 40. For example, a laminating adhesive can be used to secure the loop fabric to the support member. Examples of suitable laminating adhesives include polyolefins, polyesters, polyurethanes, polyamides, phenolic adhesives, urea-formaldehyde adhesives, epoxy adhesives, acrylate adhesives or the like. One embodiment of a suitable back-up pad is available from the 3M Company of St. Paul, Minn., under the trade designation "STIKIT" brand back-up pad, part number 05576, to which engaging assembly 20 can be laminated with, for example, a polyacrylate pressure sensitive adhesive. In another example embodiment, the support member 12 is formed around and bonded to the engaging assembly 20 in a manner similar to that used in making back-up pads that are available from the 3M Company of St. Paul, Minn., under the designation "HOOKIT II" brand back-up pad, part number 05276. For example, a polyurethane material can be foamed directly to the back side of the engaging assembly 20. If the support member 12 is foamed directly to the engaging assembly 20, the back side of the engaging assembly should be selected or treated to prevent the foam, such as polyurethane foam, from bleeding through to the loop side of the engaging assembly. Such selection is within the skill and knowledge of one having ordinary skill in the art. Typically, it is desired to avoid having the foam material on and around engaging members, such as loops 38*a* and 38*b*. One method to attenuate foam bleed-through is to apply a coating to the back of the engaging assembly to create a seal. The coating can be a thermoplastic or thermosetting polymeric material, for example. This sealant layer can be the adhesive 40 which locks the loops 38*a* and 38*b*, as explained hereinafter, or can be an additional coating provided on top of the adhesive layer 40.

Desired characteristics for the engaging assembly 20 are that it is durable, exhibits good holding power, and allows simple attachment and detachment of the abrasive article. Durability is a desirable parameter, because the back-up pad may be attached to and detached from hundreds or thousands of abrasive articles during its lifetime. Because the abrasive articles are typically disposable, meaning that they are usually discarded after one or a few uses, the durability of the back-up pad is more important than the durability of the abrasive article in the example embodiment described. Thus, it is desirable that the back-up pad 10 and particularly the engaging assembly 20, be durable enough to withstand 1000 or more heavy duty sanding uses, each use comprising attaching an abrasive article, performing heavy duty sanding for a period, and removing the abrasive article for attachment of a fresh abrasive article. The back-up pad, and particularly the engaging assembly, should permit the abrasive article to be removed with a small amount of force, but should resist movement relative to the abrasive article during use. Selection of parameters to achieve the results discussed are within the skill and knowledge of one of ordinary skill in the art.

The height of the loops 38*a* and 38*b* (i.e. the approximate average distance from the base of the loop to the top of the loop) generally ranges from about 0.025 cm (0.010 inch) to 0.625 cm (0.25 inch), typically 0.063 cm (0.025 inch) to 0.45 cm (0.175 inch), and more typically between 0.125 cm (0.05 inch) to 0.325 cm (0.15 inch). If the loop height is too large, it could allow the abrasive article to release and reattach during use, which can cause the abrasive article to "shift" and "walk" during use. This can decrease abrading performance and life of the abrasive article. Additionally, when the loops are too high they may act as a cushion or buffer allowing the abrasive article to shift relative to the back-up pad during operation while remaining engaged by the engaging assembly 20. This can reduce abrasive performance by damping the abrading action. If the loop height is too small, there may not be sufficient attachment of the hooking stems and the loop fabric. The selection of loop dimensions will depend upon the shape and type of hooking stems provided and on the desired engagement characteristics, and may be larger or smaller than those just described while remaining within the scope of the present disclosure. Such selection is within the skill and knowledge of one of ordinary skill in the art.

The loop density may also be selected to provide suitable performance characteristics. For example, the density of the loops can be the same as or different from the density of the hooks. The loop density usually ranges between about 30 and 4000 loops per $cm^2$ (about 194 to 25,000 loops per $inch^2$), typically between 40 and 3000 loops per $cm^2$ (about 258 to 19,355 loops per $inch^2$), and more typically between 50 and 150 loops per $cm^2$ (about 323 to 968 loops per $inch^2$). If the loop density is too high, the cost of the loop fabric may be prohibitive, and it may be difficult to remove the abrasive article from the back-up pad without adversely affecting one or the other component. If the loop density is significantly too high, it may be difficult for the hooks on the abrasive article to sufficiently penetrate the loops to become adequately engaged. If the loop density is too low, the peel and shear strength may be too low, which could decrease performance due to the insufficient attachment force. Selection of loop density is within the skill and knowledge of one of ordinary skill in the art.

One method of forming loops 38*a* and 38*b* in substrate 30 is described in U.S. Pat. No. 5,692,949 (Sheffield et al.), which is incorporated herein by reference. In general, loops 38*a* and 38*b* are formed by repeatedly piercing the substrate 30 and causing portions of continuous strands 36*a* and 36*b* to extend through the substrate 30, such as with a suitable needle, thereby forming a plurality of loops. The orientation of each loop is defined as the plane formed by the strand in each loop. Such loops can be typically formed with commercially available stitching machines of the type generally known as "chenille stitch" machines.

With commercially available chenille stitch machines, the substrate 30 can be moved in any direction after each stitch. Thus, the loops 38*a* and 38*b* can be made to have an orientation in any direction. This provides the ability to closely control the orientation of the loops and to stitch engaging assembly 20 in which loops 38*a* and 38*b* are oriented in different directions relative to one another by a desired amount. It has been observed that with conventional loop material used in hook and loop fasteners, the stitch pattern is generally unidirectional. However, with conventional multifilament strands, the bending that occurs when forming loops may cause the loop to twist away from the initial stitch orientation somewhat, and causes individual filaments of the strand to unwind and separate somewhat from the body of the multifilament strand itself. The orientation of the individual exposed loops is substantially varied and is not controlled or predetermined. It is desirable to provide a loop material having an engagement strength that is not substantially dependent on the peel or release direction. This is especially so with back-up pads 10 used with rotary sanders, DA sanders, orbital sanders, vibratory sanders, and the like. Chenille machines can be advantageously used to form a loop pattern that attenuates or eliminates the directionality of peel strength or engagement strength. This is accomplished by forming a loop pattern that is not unidirectional, but instead by forming a stitch loop pattern of desired multidirectionality.

For commercially available, computer-controlled chenille stitching machines, the area of the substrate to be filled is digitized and then the area can be filled in a variety of patterns. There are several fill functions typically built into the software. The general practice for filling areas with computer-controlled chenille machines is to fill with straight line stitching. This results in a very uniform loop array. Such patterns can be made, for example, with a Melco single head computer controlled chenille stitching machine, model number "CHI", available from Melco Embroidery Systems of Denver, Colo.; or with multiple head chenille stitching machines available from Tajima Industries Ltd., or Higashiku, Hagoya, Japan, such as model number "TMCE-612". In both of these commercially available machines, the substrate 30 is mounted into a frame that is moved under the stationary sewing heads by means of an X-Y transport mechanism. The transport mechanism motion is computer controlled. Loop heights can be adjusted on the above-identified computer-controlled machines with programmed height settings. Stitch length and spacing between adjacent lines of loops are also program adjustable. These two parameters determine the loop density. The loop height and density can be chosen to provide the desired engagement characteristics for the particular hooks on the abrasive article to be mounted on the back-up pad 10.

Figure 3:
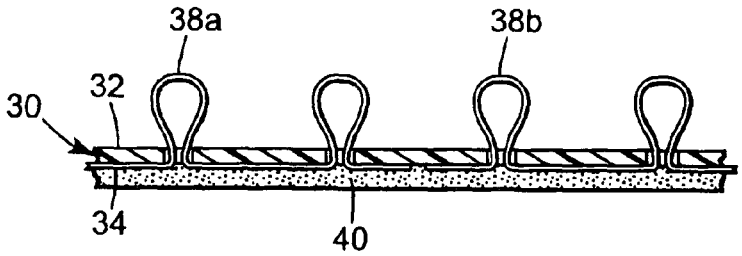
FIG. 3 is a cross-sectional view of an example embodiment of an engaging assembly according to the present disclosure.

The chenille stitch method described above does not lock each loop. Accordingly, the loops are connected to one another, but are not tied or locked in place. For example, if one loop 38*a* is pulled up through the substrate 30, it will pull the strand 36*a* from adjacent loops. It is therefore necessary to lock all of the loops in place. This is typically done by adding adhesive layer 40 to second surface 34 of substrate 30 after forming the loops 38*a* and 38*b*. Such an arrangement is illustrated in FIG. 3. The adhesive should be chosen to satisfy the following criteria. The adhesive should provide a strong enough bond to lock the stitches and prevent pull out of loops 38*a* and 38*b* during operation of the sander and during removal of abrasive articles from the back-up pad 10. The adhesive should be sufficiently heat resistant so as to not be adversely affected by the heat generated during the manufacturing process and during sanding operations. For back-up pads in which the engagement assembly 20 is foamed into the support member 12, the adhesive should not be adversely affected by the heat generated during the foam-in and cure of the support member, and should not react with or be degraded by the material of the support member 12 in such a way as to adversely affect the adhesive or the support member. When the engaging assembly is to be foamed-in when making the support member 12 of the back-up pad, it is typical to apply sufficient adhesive either as a single layer 40 or multiple layers 40 to seal the porosity of the stitched substrate 30 thereby minimizing or eliminating bleed-through of the foamed material during the foam-in process. Suitable types of adhesives include, but are not limited to, polyolefins, polyesters, polyurethanes, polyamides, phenolic adhesives, urea-formaldehyde adhesives, epoxy adhesives, acrylate adhesives, and the like. Particular examples of such adhesives include latex acrylonitrile/butadiene/styrene (ABS) and latex based acrylic adhesives available under the trade designation "HYCAR" from Noveon, Inc., Cleveland, Ohio; two part epoxies such as "EPI-REZ WD 510" available from Resolution Performance Products, Houston, Tex., with "JEFFAMINE T403" available from Huntsman Performance Chemicals, Houston, Tex.; and 2 part reactive polyurethane adhesives such as "VERSALINK P-1000" available from Air Products and Chemical Corporation of Allentown, Pa. with "ISONATE 143L" available from Dow Chemical Company, "RIBBON FLOW" urethane elastomers available from Crompton Corp., Middlebury, Conn.; and polyamide hot melt adhesive sheets available under the trade name "BEMIS 4220" from Bemis Associates, Inc., Shirley, Mass. It is also possible to provide an optional coating, film, or tightly woven or non-woven facing (not shown) on the exposed surface of adhesive layer 40 to further seal the substrate 30 and to protect and isolate the adhesive during foam-in process, for example, "SNOWEB 125", from Snow Filtration Co., Cincinnati, Ohio.

As previously discussed, it is preferred for the engaging members to have higher durability when located in areas of higher operating stresses. FIGS. 4–6, discussed following, illustrate application of the teachings of the present disclosure. Generally, the higher durability engaging members are positioned in areas of high or accelerated wear from operating stresses.

FIG. 4 illustrates an example embodiment of a dual region engagement assembly according to the present disclosure. Back-up pad 50 comprises a substantially circular first region 52 including a first engaging means 53 (loops or their equivalent) and a substantially circular second region 54 including a second engaging means 55 (loops or their equivalent). The back-up pad 50 may optionally include ventilation holes 56 to aid in dust extraction.

The first 52 and second 54 regions may be substantially concentric circles (as is shown in FIG. 4), wherein the first region 52 surrounds the second region 54. In another embodiment, the first region comprises a plurality of arcuate regions substantially adjacent with the second region, wherein the oblique arcs surround the ventilation holes of the back-up pad. In yet another embodiment, the arcuate sections or regions may be interconnected along the perimeter of the first region. Furthermore, it is permissible to have a gap between the first and second region, typically up to 1/16 inch (1.6 mm).

First engaging means 53 and second engaging means 55 differ in durability. First region 52 is substantially adjacent to, and surrounds, second region 54 and is substantially coterminous with the perimeter of back-up pad 50. First region 52 is a higher durability region than the second region 54. The higher durability region is more durable than the lower durability region and better resists the forces that cause faster wearing of loops in the first region 52. The increased durability can be accomplished by various methods. When the engaging means of the first 52 and second 54 regions are made from the same materials, increasing the diameter of each loop (in the first region) 52 increases the durability in the first region 52. For example, when using loops made from nylon 66, the loops of the first region are made from fibers 0.006 inches (0.152 mm) in diameter and the loops of the second region are made from fibers 0.004 inches (0.101 mm) in diameter, resulting in the first region 52 having a loop durability of about 1361 grams and the second region having a loop durability of about 613 grams. If a loop of the same material (nylon 66) and having a diameter of 0.005 inches (0.127 mm) were substituted in either of the first or second regions, the loop durability would be 959 grams. Alternatively, if the diameters of the loops fibers are the same in both the first and second regions, the durability of the loops in the first region can be made from a stronger material. For example, if the loops in both regions are about 0.004 inches (0.101 mm), the first region could have loops made from "KEVLAR" brand aramid fiber (available from E. I. du Pont de Nemours and Company, Wilmington, Del.) and the second region could have loops made from nylon 66, resulting in the first region 52 having a loop durability of 2416 grams and the second region having a loop durability of 613 grams.

FIG. 5 illustrates a plan view of another example embodiment of a back-up pad according to the present disclosure. Back-up pad 60 comprises a plurality of arcuate first regions 62 including a first engaging means 63 surrounding ventilation holes 66. A second region 64, including a second engaging means 65, is substantially adjacent to arcuate first regions 62. First engaging means 63 and second engaging means 65 differ in durability, typically by the first engaging means having a larger diameter than the second engaging means when first and second engaging means are the same material, such as is described in the preceding paragraph.

FIG. 6 illustrates a plan view of yet another example embodiment according to the present disclosure. Back-up pad 70 comprises a plurality of interconnected arcuate first regions 72 including a first engaging means 73 surrounding ventilation holes 76. A second region 74, including a second engaging means 75, is substantially adjacent to, and surrounded by, interconnected arcuate first regions 72. First engaging means 73 and second engaging means 75 differ in durability. The embodiment illustrated in FIG. 6 combines the areas of higher durability as shown in FIGS. 4–5 to locate the higher durability engaging members in regions of higher operating stress.

The back-up pad of the present disclosure is typically used with any abrasive article having hooks projecting from one surface thereof, which can be engaged by the engaging assembly of the present disclosure. The abrasive article 80 shown in FIG. 7 could have any desired shape, including but not limited to a circle, an oval, a polygon (such as a rectangle, square, or a star), or a multi-lobed shape (such as a daisy). The abrasive article 80 includes a working surface 82 and a back surface 84 having hooking stems 90. Typical abrasive articles include those disclosed in U.S. Pat. No. 5,505,747 (Chesley et al.), discussed above.

Figure 7:
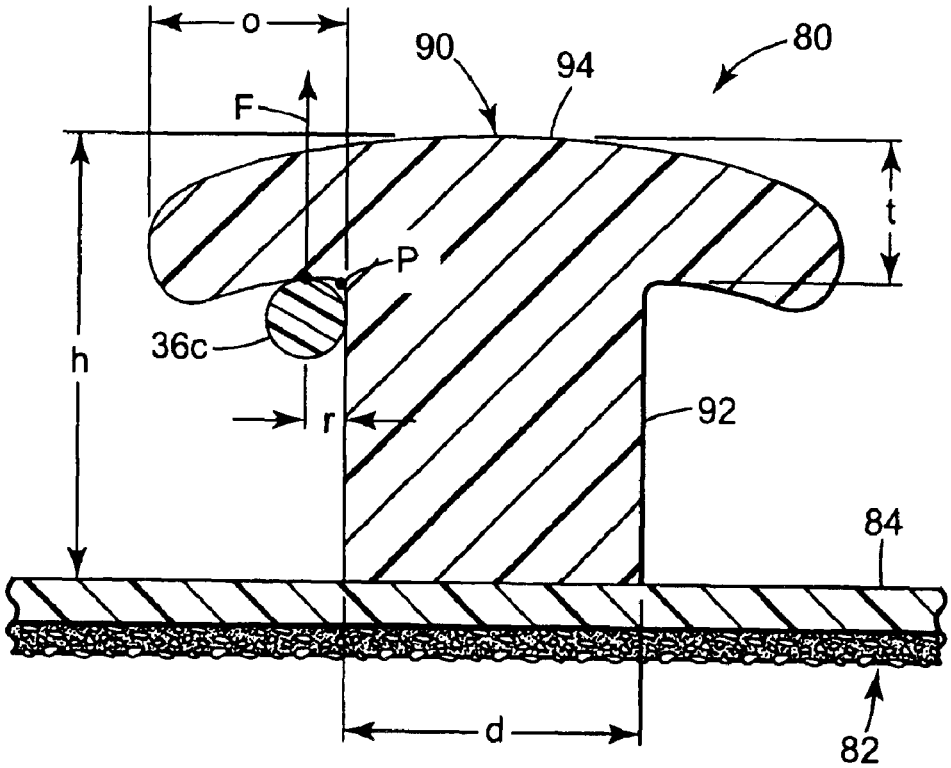
FIG. 7 is a cross-sectional view of an abrasive article with a hook engaged by the engaging means according to one aspect of the present disclosure.

The various embodiments of the engaging assembly described herein are well suited for use with abrasive articles having hooks of the general shape illustrated in FIG. 7. In the illustrated embodiment, hook 90 comprises a cylindrical stem 92 having a head 94 generally in the form of a disc, or concave or convex mushroom head. The head 94 overhangs the stem 92. Hook 90 can be of the following dimensions. Total hook height (h) of from 0.51 to 0.66 mm (0.020 to 0.026 inches), head thickness (t) of from 0.075 to 0.10 mm (0.003 to 0.004 inches), a stem diameter (d) of from 0.38 to 0.64 mm (0.015 to 0.025 inches), with the head overhanging the stem at (o) by approximately 0.075 to 0.15 mm (0.003 to 0.006 inches). The engaging assembly described with respect to FIGS. 4, 5 and 6, and having the following dimensions, are particularly well-suited for use with such hooks 90: typical loop height of from 1.8 to 3.0 mm (0.070 to 0.118 inches); and typical stitch density of from about 55 to 85 loops per $cm^2$ (350 to 550 loops per $inch^2$), and more typically approximately 70 loops per $cm^2$ (450 loops per $inch^2$). It is to be understood however, that other loop stitch patterns and dimensions can be chosen within the scope of the present disclosure and may be varied for particular hook shapes and dimensions other than as illustrated, and for particular engagement characteristics as desired.

Referring again to FIG. 1, for durability of the engaging assembly 20, it is typical that the strands 36*a* and 36*b*, shown as strand 36*c*, have a strength and diameter selected to be able to impart a sufficient torque to the intended hook on the abrasive article to allow the loops 38*a* and 38*b* to slip off the hook 90 without breaking the strand. For a back-up pad engaging assembly 20 to provide a secure engagement to the abrasive article during heavy duty sanding operations, the diameter of the strands 36*a* and 36*b* should be chosen such that sufficient torque to allow the loop to slip off is not imparted by the forces during sanding. Also, the strands 36*a* and 36*b* should have sufficient strength to withstand the repetitive stresses imparted during sanding operations. Such selection is within the skill and knowledge of one having ordinary skill in the art.

For engagement assembly 20 to be used with the hook 90 having the configuration and dimensions described above, it has been found advantageous to use a monofilament strand 36*a* of 180 denier nylon 66, 0.152 mm (0.006 inches) diameter, and strand 36*b* of 80 denier nylon 66, 0.102 mm (0.004 inches) diameter, although the present disclosure is not thereby limited. Such strands have been found to withstand the numerous large impulsive forces imparted by heavy duty DA sanding while having a diameter small enough to provide sufficient engagement strength during operation. Such strands are also capable of imparting sufficient torque to the hook 90 to allow the loops 38*a* and 38*b* to slip off without breaking the strands.

The material from which the monofilament or multifilament strand 36 is made may be selected as desired, and can include such organic materials as thermoplastic and thermosetting materials like polyamides (such as nylon), polyolefins, polyurethanes, aramids, polyester, cellulosic materials, or such inorganic materials as metal (including aluminum or steel) or ceramic (including glass and fiberglass). The strand may also be a combination of different materials. The strand may be straight, curved, or twisted, and may contain a surface treatment of some type, such as an antistatic coating, or silicone. The surface coating may be selected to aid in the stitching process. Typical monofilament strands include, but are not limited to, nylon monofilaments available commercially from Shakespeare Monofilament Specialty Polymers Co., Columbia, S.C., including "SHAKESPEARE SN-38 TEX #8" (80 denier) and "SHAKESPEARE SN-38 TEX# 18" (180 denier).

The operation of the present disclosure will be further described with regard to the following detailed examples. These examples are offered to further illustrate the various specific and example embodiments and techniques. It should be understood, however, that many variations and modifications may be made while remaining within the scope of the present disclosure.

EXAMPLES

Test Methods

Short term and long term durability of the back-up pads were determined by the following test methods. The three-mode test described below indicates engaging assembly durability under short term-high stress sanding conditions. The accelerated wear test indicates the life of the engaging assembly, i.e., the number of sanding cycles and abrasive disc removals and attachments. The free-spin test indicates the strength of attachment between the engaging assembly and the abrasive article. The accelerated wear test is a method to indicate the frictional resistance of the loop material.

Free-Spin Test

Step 1) An abrasive disc, commercially available under the trade designation "HOOKIT II", from 3M Company, was attached to the back-up pad using two firm pats by the operator's hand. The back-up pad was then attached to a dual action air sander, available under the trade designation "DAQ" from National-Detroit Inc., Rockford, Ill.

Step 2) The abrasive disc was rotated by the pneumatic dual action sander, horizontally face down, for 30 seconds, wherein the dynamic air pressure at the tool (the air pressure with the back-up pad allowed to rotate freely) was approximately 413.7 kPa (60 pounds per square inch). The sander was then switched off.

Step 3) The degree to which the disc detached from the engaging assembly was rated according to the following scale:

5—disc remained 100% attached, no shifting

3—disc less than 100% attached, or shifted slightly

1—disc detached from the back-up pad.

Three-Mode Test Procedure

Step 1) As per Step 1 of the free-spin test, the abrasive disc was attached to the back-up pad using two firm pats by the operator's hand. The abrasive disc was then removed from the back-up pad and replaced on the back-up pad, again using two firm pats by the operator's hand. The placement, removal, and replacement steps were intended to simulate repetitive use of the abrasive disc, and to simulate repositioning a disc that had been mis-positioned.

Step 2) The abrasive disc was rotated by the pneumatic dual action sander, wherein the dynamic air pressure at the tool (the air pressure with the back-up pad allowed to rotate freely) was approximately 413.7 kPa (60 pounds per square inch). The abrasive face of the rotating abrasive disc was contacted to a flat, 14 gauge steel panel, at approximately a 3–5 degree angle between the panel and the plane of the abrasive disc at a force of approximately 110 Newtons (25 lb.). The sanding action was from side-to-side 5 times, then toward and away from the operator 5 times, at approximately 1 second per sweep.

Step 3) The amount of initial "grab" was recorded according to the scale below.

Step 4) The abrasive disc was detached from the back-up pad of the dual action air sander, and then Step 1 was repeated.

Step 5) Step 2 was repeated wherein the angle between the panel and the plane of the abrasive disc was adjusted to a 10–15 degrees.

Step 6) Step 4 was repeated.

Step 7) Step 2 was repeated wherein the angle between the panel and the plane of the abrasive disc was adjusted to 30–35 degrees.

Step 8) The amount of final "grab" and "3-mode" ratings were recorded. "Grab" is a subjective measure of the force required to remove the disc from the back-up pad. The initial and final grab ratings were was assigned according to the following criteria:

5—Excessive

4—Heavy

3—Target

2—Low

1—Extremely low

"3-mode" is a subjective measure of the integrity of the hook and loop attachment system, rated according to the following criteria:

5—Superior, with no significant puckering (separation of the disc from the back-up pad) or wrinkling (creases in the disc). The abrasive disc stayed firmly attached to the back-up pad during the test.

4—Slight wrinkling of the abrasive disc, with either the center or the edge of the disc noticeably separated from the back-up pad.

3—Noticeable puckering (up to 25% of the disc separated from the back-up pad) or wrinkling (one or two creases with lengths less than 25% of the diameter of the disc).

2—Severe wrinkling and puckering of the abrasive disc; less than 50% of the disc in contact with the back-up pad.

1—Unacceptable; the abrasive disc detached from the back-up pad during the test.

Accelerated Wear Test

Step 1) The condition of the back-up pad was visually inspected and then attached to a motor, available under the trade designation "FCD MODEL 2105-21-020" from FCD Corporation, Irving, Tex. The total weight of the motor assembly and back-up pad was approximately 20 pounds Step 2) The back-up pad was positioned on a freely rotatable plate at a 10±1 degree angle.

Step 3) The plate was rotated at a speed of 3,520 rpm.

Step 4) The degree of wear of the engaging assembly was monitored at regular intervals.

Step 5) When the stitched loops of the outer ¾-inch (19 mm) perimeter of the back-up pad were worn away the test was stopped and the number of hours recorded.

Comparative 1

An engaging assembly was made by loop stitching 0.004 inch (80 denier) nylon 66 yarn, commercially available under the trade designation "SHAKESPEARE SN-38 SMOKE COLOR TEX# 8" from Shakespeare Monofilament Specialty Polymers Co., Columbia, S.C., into a 2.08 yards$^2$/pound (3.83 meters$^2$/kilogram) rayon fabric, commercially available under the trade designation "PFC LYOCEL JEANS", from Milliken & Company, Spartenburg, S.C., using a multiple head chenille stitching machine, model number "TMCE-612", available from Tajima Industries Ltd., Hagoya, Japan. Face-side loop density was 450 loops/inch$^2$ (70 loops/cm$^2$) and loop height was 2.4±0.4 mm.

The stitched loops were then locked into position by heat sealing to the backside of the fabric three polyamide hot melt adhesive sheets, 0.005/0.007/0.005 inch (0.127/0.177/0.127 mm) thick, available under the trade name "BEMIS 4220" from Bemis Associates, Inc., Shirley, Mass., at 370° F. (187.8° C.) and 100 psi (689.6 kPa) for 50 seconds. The hot melt adhesive sheets were then covered with a 50/50 cellulose/polyester blend non-woven web having a weight of 1.25 ounces/yard$^2$ (42.4 grams/meter$^2$), available under the trade designation "SNOWEB 125", from Snow Filtration Co., Cincinnati, Ohio, and heat sealed at 370° F. (187.8° C.) and 80 psi (551.6 kPa) for 25 seconds.

The engaging assemblies were then molded onto polyurethane supports and converted into six-inch (15.2 cm) diameter back-up pads by Perry Chemical & Manufacturing Company, Lafayette, Ind.

EXAMPLES 1–4

Back-up pads were made according to the same procedure as described for making Comparative Sample 1, using either 0.005 inch (130 denier) or 0.006 inch (180 denier) nylon 66 monofilament yarn, commercially available under the trade designation "SHAKESPEARE SN-38 SMOKE COLOR TEX# 14" and "SHAKESPEARE SN-38 SMOKE COLOR TEX# 18" from Shakespeare Monofilament Specialty Polymers Co., at loops densities according to TABLE 1:

TABLE 1

| EXAMPLE | MONOFILAMENT DIAMETER (INCHES) | LOOP DENSITY (LOOPS/INCH$^2$) |
|---|---|---|
| 1 | 0.005 (130 Denier) | 450 (70 loops/cm$^2$) |
| 2 | 0.006 (180 Denier) | 450 (70 loops/cm$^2$) |

Examples 1–4 and Comparative 1 were evaluated by the free-spin, the 3-mode and the accelerated wear tests. Results listed in TABLE 2 represent the average ratings of testing four pads, three abrasive discs per pad.

TABLE 2

| SAMPLE | FREE-SPIN (Rating) | INITIAL GRAB (Rating) | FINAL GRAB (Rating) | 3-MODE (Rating) | ACCELERATED WEAR (Hours to failure) |
|---|---|---|---|---|---|
| Comparative 1 | 4.8 | 2.9 | 3.5 | 5 | 8 |
| Example 1 | 3.4 | 2.5 | 2.7 | 5 | 24 |
| Example 2 | 2.0 | 2.1 | 1.9 | 5 | 31 |

EXAMPLE 3

A back-up pad having a first and second region of different durability loops was made as follows. An engaging assembly as described in Comparative 1 (80 denier/70 loops/cm$^2$) was die cut into a 5 inch (12.7 cm) disc and bonded to the center of a 6 inch (15.2 cm) polyurethane support. To this back-up pad was bonded an engaging assembly as described in Example 2, (180 denier/70 loops/cm$^2$), die cut as a ring of inner diameter 5 inches (12.7 cm) and outer diameter 6 inches (15.2 cm). Both Example 3, and a comparative back up pad commercially available under the trade designation "HOOKIT II", part number 05276, from 3M Company, had zero failures according to the free-spin test.

EXAMPLE 4

Engaging assemblies were made according Example 1, wherein the multiple head chenille stitching machine was programmed to stitch a 5-inch (12.7 cm) inner region of "SHAKESPEARE SN-38 SMOKE COLOR TEX# 8" (80 denier) at 70 loops/cm$^2$ and a 1-inch (2.5 cm) outer ring of "SHAKESPEARE SN-38 SMOKE COLOR TEX# 18" (180 denier), also at 70 loops/cm$^2$, and subsequently converted into 6-inch back-up pads. Example 4 and Comparative 1 were evaluated, (4 pads, 3 discs per pad), for free-spin, 3-mode and accelerated wear. Results are listed in TABLE 3.

TABLE 3

| SAMPLE | FREE-SPIN (Rating) | INITIAL GRAB (Rating) | FINAL GRAB (Rating) | 3-MODE (Rating) | ACCELERATED WEAR (Hours to failure) |
|---|---|---|---|---|---|
| Comparative 1 | 5 | 3 | 3 | 5 | 8 |
| Example 4 | 5 | 3 | 3 | 5 | 30 |

What is claimed is:

1. A back-up pad for supporting an abrasive article comprising:

a first major surface;

an engagement layer bonded to said first major surface, the engagement layer comprising:

a first region including a plurality of first engagement means, and a second region including a plurality of second engagement means, wherein the first and second engagement means have substantially different durability.

2. The back-up pad of claim 1, further including a second major surface opposite the first major surface, and a plurality of ventilating apertures extending therebetween.

3. The back-up pad of claim 1, wherein the first engagement means and the second engagement means are loops having about the same diameter, and further wherein first engagement means are made of a first material and second engagement means are made from a material different than the first material.

4. The back-up pad of claim 1, wherein the first engagement means have a first diameter and the second engagement means have substantially different diameter, and further wherein first and second engagement means are made from a monofilament material.

5. The back-up pad of claim 1, wherein the first and second regions are substantially concentric circles, wherein the first region surrounds the second region.

6. The back-up pad of claim 5, wherein the first engagement means have a diameter of about 0.006 inches (0.152 mm)

7. The back-up pad of claim 6, wherein the second engagement means have a diameter of about 0.004 inches (0.101 mm).

8. The back-up pad of claim 3, wherein the first and second engagement means are loops selected from the group consisting of stitched loops, tricot loops, formed loops, brushed loops, or non-woven loops.

9. The back-up pad of claim 1, wherein the first and second engagement means are made from the same material.

10. The back-up pad of claim 9, wherein the loop material is selected from a group consisting of nylon, nylon 66, or aramid.

11. The back-up pad of claim 1, wherein the first and second regions overlap.

12. The back-up pad of claim 11, wherein the overlap is up to 10 percent of the total pad area.

13. The back-up pad of claim 5, wherein the first and second regions are separated by a gap therebetween.

14. An apparatus for use with an abrasive article having a backup plate including a hook and loop type fastening system, the apparatus including:

a rotary tool;

a back-up pad coupled to the tool, the back-up pad including:

a first region including a plurality of first engagement means, and a second region including a plurality of second engagement means, wherein the first and second engagement means have substantially different durability.

15. The apparatus of claim 14, wherein the first and second engagement means are loops having about the same diameter, and further wherein first engagement means are made of a first material and second engagement means are made from a material different than the first material.

16. The apparatus of claim 14, wherein the first engagement means and the second engagement means are loops having substantially different diameter.

17. The apparatus of claim 14, wherein the first region surrounds the second region.

18. The apparatus of claim 16, wherein the first engagement means have a diameter of about 0.006 inches (0.152 mm)

19. The apparatus of claim 18, wherein the second engagement means have a diameter of about 0.004 inches (0.101 mm).

20. The apparatus of claim 19, wherein the first and second engagement means are made from the same material.

21. The apparatus of claim 20, wherein the material is selected from a group consisting of nylon, nylon 66, or aramid.

22. The apparatus of claim 14 wherein the first and second regions overlap.

23. The apparatus of claim 17, further including a gap between the first and second regions.

24. A method of making a back-up pad comprising:

providing a support member pad having a first region and a second region;

forming a first engagement means in the first region; and forming a second engagement means on the second region, wherein the first and second engagement means have substantially different durability.

25. The method of claim 24, wherein the first engagement means have a diameter of about 6 mils (0.152 mm) and the second engagement means have a diameter of about 4 mils (0.101 mm).

26. The method of claim 24, wherein the second region is contained within the first region.

27. The method of claim 24, wherein the first region is an outer region and the second region is an inner region; and the inner and outer regions include a gap therebetween.

28. The method of claim 27, wherein the gap is less than about 1/16 of an inch.

29. An assembly for bonding to a back-up pad comprising:

a substrate;

a first region of first engagement means bonded to the substrate; and a second region of second engagement means bonded to the substrate, wherein the first and second engagement means have substantially different durability.

30. The assembly of claim 29, wherein the first and second engagement means are loops having the same diameter and further wherein first engagement means are made of a first material and second engagement means are made from a material different than the first material.

31. The assembly of claim 30, wherein the first engagement means have a diameter of about 0.006 inches and the second engagement means have a diameter of about 0.004 inches.

32. The assembly of claim 31, wherein the first region surrounds the second region.

33. The assembly of claim 32, further including a gap between the first and second regions.

34. The assembly of claim 29, wherein the loops are made from the same material.

35. The assembly of claim 34, wherein the material is selected from a group consisting of nylon, nylon 66, or aramid.

36. A method of making an assembly for bonding to a back-up pad comprising:

providing a substrate;

forming a first region of first engagement means bonded to the substrate; and forming a second region of second engagement means bonded to the substrate, wherein the first and second engagement means have substantially different durability.

37. A method of using an assembly for bonding to a back-up pad:

providing a substrate;

forming a first region of first engagement means bonded to the substrate; and forming a second region of second engagement means bonded to the substrate; and engaging the substrate to the backup pad, wherein the first and second engagement means have substantially different durability.

38. A back-up pad having first and second opposed major surfaces and at least one aperture extending between the surfaces, the back-up pad also including an outer perimeter, the back-up pad comprising:

a first region having a first engagement means; and at least one aperture engagement region having a second engagement means, wherein the aperture engagement region extends inwardly from the outer perimeter to the aperture and further wherein the second engagement means has a substantially higher durability than the first engagement means.

39. The back-up pad of claim 38, wherein the backup pad includes a plurality of apertures and further wherein each aperture includes a corresponding aperture engagement region.

40. The back-up pad of claim 39, further including a third engagement region, wherein the third engagement region extends between the aperture engagement regions and includes third engagement means the same as the second engagement means.

41. The back-up pad of claim 40, wherein the third engagement region extends inwardly from the outer perimeter.

42. The back-up pad of claim 38, wherein the aperture engagement region includes a section surrounding the at least one aperture.

43. A back-up pad comprising:

a substrate having first and second opposed surfaces, the first surface including an outer boundary, the first surface further comprising:

a first engagement region having a plurality of first engagement members made from fibers having a diameter of about 0.006 inches, wherein the first attachment region is substantially annularly shaped and has an inner and an outer edge, the outer edge adjoining the first surface outer boundary;

a second engagement region having a plurality of second engagement members made from fibers having a diameter of about 0.004 inches, wherein the second attachment region is substantially circularly shaped and is located inside the first engagement region.

44. The back-up pad of claim 43, wherein the first and second engagement regions include a gap therebetween.

45. The back-up pad of claim 43, wherein the first and second engagement members are loops made from nylon 66.

46. The back-up pad of claim 43, further including a plurality of apertures passing between the first and second surfaces.

47. The back-up pad of claim 46, wherein an each aperture is encircled by a corresponding aperture engagement region, and further wherein each aperture engagement region depends from the inner edge of the first engagement region and extends in an arcuate shaped to encircle corresponding aperture, the aperture engagement region comprising:

a plurality of third engaging members having substantially the same diameter and made from the same material as the first engaging members.

* * * * *